US006880322B1

(12) United States Patent
Hirsch

(10) Patent No.: US 6,880,322 B1
(45) Date of Patent: Apr. 19, 2005

(54) OPENING ROLLER HOUSING FOR AN OPEN-END SPINNING DEVICE, DEVICE FOR AN OPENING ROLLER HOUSING AND PROCEDURE FOR MODERNIZING SPINNING DEVICES

(75) Inventor: Albert Hirsch, Ingolstadt (DE)

(73) Assignee: Rieter Ingolstadt Spinneremaschbau. AG, Ingolstadt (DE)

( * ) Notice: Subject to any disclaimer, the term of this patent is extended or adjusted under 35 U.S.C. 154(b) by 0 days.

(21) Appl. No.: 10/684,216

(22) Filed: Oct. 11, 2003

(51) Int. Cl.[7] ..... D01H 4/32
(52) U.S. Cl. ..... 57/400; 57/408; 57/416
(58) Field of Search ..... 57/400–417

(56) References Cited

U.S. PATENT DOCUMENTS 3,975,895 A 8/1976 Stahlecker
4,700,431 A * 10/1987 Artzt et al. ..... 19/105
5,398,494 A 3/1995 Wassenhoven et al.

FOREIGN PATENT DOCUMENTS

DE 4424113 A1 1/1996
DE 19933600 2/2000
DE 10224589 1/2003

OTHER PUBLICATIONS

EPO Search Report, May 13, 2004.
German Patent Office Search Report, Dec. 12, 2002.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

An exchangeable insert is proposed as auxiliary equipment for a housing of a disintegrating apparatus of an open-end spinning apparatus. The insert is adaptable, so that the disintegrator roll housing can be made to conform to various spinning conditions. In a partial zone, in accord with this proposition, the insert replaces a circumferential wall of the disintegrator roll housing, wherein the insert extends itself into to a zone of a contamination separation opening of the disintegrator roll housing. Its extension in the axial direction is so chosen, that it, at least partially, forms a portion of the circumferential wall of the disintegrator in the area of the contamination separation opening.

18 Claims, 2 Drawing Sheets

OPENING ROLLER HOUSING FOR AN OPEN-END SPINNING DEVICE, DEVICE FOR AN OPENING ROLLER HOUSING AND PROCEDURE FOR MODERNIZING SPINNING DEVICES

FIELD OF THE INVENTION

The present invention concerns a disintegrator roll housing, whereby an insert is placed in an area, following the feed entry of the band as seen in the direction of rotation of the disintegrating drive shaft and further concerns a procedure for the modernization of an open-end spinning apparatus, whereby an insert of the disintegrator roll housing can be removed and subsequently replaced.

BACKGROUND OF THE INVENTION

Disintegrator roll housings are known in multitudinous designs within the state of the technology, including the spinning units SE7, SE8 and SE9 of a rotor based spinning machine "Autocoro" of W. Schlafhorst AG & Co., 41061 M önchengladbach, DE. The disintegrator roll housings of these spinning units consist essentially of individual segments, which are placed on a carrier plate. The individual segments, which are set on this carrier plate, thus form the circumferential wall of the distintegrator housing, particularly in the zone between the fiber band feed equipment and the contamination separation opening of the disintegrator roll housing.

This type of construction of a disintegrator roll housing brings with it the disadvantage that, following the entry of the fiber band by a suction condition, which suction extends itself from the housing of the rotor to that of the disintegrator, a large volume of air is pulled in. That air, which is induced particularly in the area of the contamination separation opening, can only be controlled as to quantity by regulation of the suction of the spinning chamber. This apparatus has, however, the general disadvantage that, in reference to the actually required air, excessive air is continually fed into the disintegrator roll housing. The result of this is that the incoming air itself can lead to difficulties within the disintegrator roll housing. Large cross-sectional openings in the area of the air flow entering the disintegrator roll housing do not yield optimal contamination combing-out and removal conditions. Such excess air leads, for example, to entrained particle dissipation, since the air exits from the disintegrator roll housing in an uncontrolled manner and carries with it fibers, which aggregate in the area of the spinning machine. This action results in disturbances in the operation of the machine.

An unpublished application DE 102 24 589.4 describes a disintegrator roll housing, wherein the circumferentially disposed wall of the disintegrator roll housing is formed by an exchangeable insert placed between the contamination separation inlet and the exit opening for fibers. Thereby, it is intended that the contamination removal can be effected and made adaptable to various fibers. The disintegrator roll housings in accord with the state of the technology have the disadvantage that the contamination separation can vary as to quantity, however, the known inserts are not designed to bring about a conformation of the disintegrator roll housings to the varying loads. The result of this is that the known disintegrator roll housings cannot be made to suit different fiber materials and other spinning conditions. Further, with the conventional segments, the zone of the contamination separation is not designed, so that the disintegrator rolls are covered, particularly about their edges. Moreover, the size of the contamination separation openings can be changed only insufficiently to meet optimal requirements, and especially the location of the openings in relation to the fiber feed (feed opening in the disintegrator roll housing) cannot be altered.

SUMMARY OF THE INVENTION

Thus, a principal purpose of the present invention is to propose a disintegrator roll housing, which avoids the disadvantages of the state of the technology, as well as to propose an insert, which has the capability of adjusting the disintegrator roll housing during the operation of the disintegrator under different spinning conditions. A further purpose of the present invention is to propose a procedure to modernize the open-end spinning apparatuses, which now adhere to the state of the technology. Various features and advantages of the invention will be set forth in part in the following description, or may be obvious from the description, or may be learned through practice of the invention.

The present purpose, in accord with the invention, is to be achieved by a disintegrator roll housing having an insert extending itself up to the area of the contaminant separation opening of the disintegrator roll housing. Further, when seen in the axial direction, in relation to the disintegrating roll, the insert forms at least partially the circumferential wall of the disintegrator roll housing in the area of the contamination separation opening. By the use of an invented insert, a disintegrator roll housing, in a simple way, can be made to accommodate itself to various spinning conditions. Further, a disintegrator roll housing now in accord with the state of the technology can be modernized by means of the procedure of the invented procedure.

The achievement of the invention is such that, the disintegrator roll housing can be designed, so that, in accord with the invention, the input of air into the disintegrator roll housing can be better controlled and further, the position of the inlet on the disintegrator roll housing where the air intake takes place is similarly optimized. Likewise, the air content within the disintegrator roll housing can be essentially improved with the control and positioning. An additional advantage arises in that, with the aid of the invention, existing slots between the disintegrator roll housing and the associated rolls, even in the area of the contamination separation inlet, can be blocked, so that an agglomeration of fibers at the slots can be avoided.

The invented insert has the advantage of fulfilling the function of the circumferential wall of the disintegrator roll housing, especially in the area of the contamination separation inlet, so that, even here, the edges of the disintegrator roll are covered. As to the circumferential wall of the disintegrator roll housing, only the part of the disintegrating roll is exposed, which is equipped with a processing surface. Advantageously, the disintegrator roll housing, following (in the direction of rotation of the disintegrator shaft) the contamination separation opening, possesses an abutment for the insert, so that the insert can be positioned in that area, where it comes into contact with the remaining components of the disintegrator roll housing.

In a particularly advantageous design, the disintegrator roll housing possesses a lateral limitation in the area of the contamination separation inlet, while the oppositely situated limitation of the contamination separation inlet is constructed at the insert. In this way, it becomes possible to exchange the insert, or to reset it anew, in the disintegrator roll housing, particularly in the axial direction of the roll.

This permits an advantageous opening between the insert and the disintegrator roll housing.

The lengthening of the combing-out zone for the fiber band is advantageously achieved by a design of the fiber band support at the insert, whereby a joining of the fiber band feed to the disintegrator roll housing is carried out. Thereby, upon the disintegration of the fiber band, the quantity of contaminant is separated, and fiber is improved in its quality, that is to say, that fewer good fibers (in excess of 10 mm) are expelled, while the ejection of lighter contaminant is not adversely affected.

By the diminishing of the cross-sectional opening of the air intake at the suction point in the area of the contaminant separation, the velocity of the airflow is increased, which leads to a corresponding diminishing of the loss of good fibers. In this way, it is possible to disintegrate even fiber bands comprised of reclaimed material, which possess a high short fiber content and to work the corresponding fibers into yarns of high quality value.

By means of the invented design of the insert with at least one forked projection arrangement, the achievement attained is that, the circumferential wall of the disintegrator roll housing in the area of the contaminant separation opening can be constructed with the aid of the invented insert. By the formation of the forked insert, at the same time, the size of the contaminant separation agrees exactly in its width with the width of the active surface of the disintegration roll. In this way, the insert can possess two forklike projections, so that the left and the right limitation of the contaminant separation opening is formed by the insert.

In an additional advantageous design of the invention, the insert incorporates the contaminant separation opening, whereby even the area following the contaminant separation opening ("after" as seen in the direction of the motion of the fibers) can be located on the insert itself. This enables that even this area, for example, in the form of coatings or other geometrical formations can be optimally adapted to various spinning conditions. The area after the contamination separation suffers high abrasion, due to many types of fibers, so that an abrasive wear in this area need not lead to a situation in which the entire disintegration roll housing needs to be replaced. In accord with the invention, it would be sufficient simply to make a replacement with a new insert into the disintegrator roll housing.

In an especially advantageous development of the invention, the insert possesses rounded off edges in the area of the air inlet at the contamination separation opening, in order that the flow of incoming air, which occurs in this area, is assured of undisturbed flow in the greatest possible manner. It is particularly advantageous, if the insert is placed on the disintegrator roll housing with a capability of being exchanged, especially where fastening means are concerned.

The fastening means, for example, are in the form of bolt borings or the like. By means of the design, wherein the insert in the area of the contamination separation covers the edges of the disintegrator roll, the advantageous achievement is, that no fibers can migrate in this area too far outside of the surface prepared roll. In the case of a favorable formation, the forklike projections impinge on an abutment, whereby they lie on the disintegrator roll housing. In this way, an exact positioning of the insert is possible.

An achievement of the invented procedure is that an open-end spinning apparatus conforming to the state of the technology can be reworked in such a manner, so that the apparatus can be modernized Thereby, in the area of the contaminant separation, the open-end spinning apparatus possesses a controllable air inflow, as it does in the area following the feed of the fiber band. Simultaneously, it is possible to bring about positive effects on the quantity of the contaminant separation where the circumferential wall of the disintegrator roll housing is concerned, both before and after the contamination separation opening. Further advantageous embodiments of the invention are described in the subordinate claims or alternate independent claims.

The present invention is more completely explained with the aid of drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
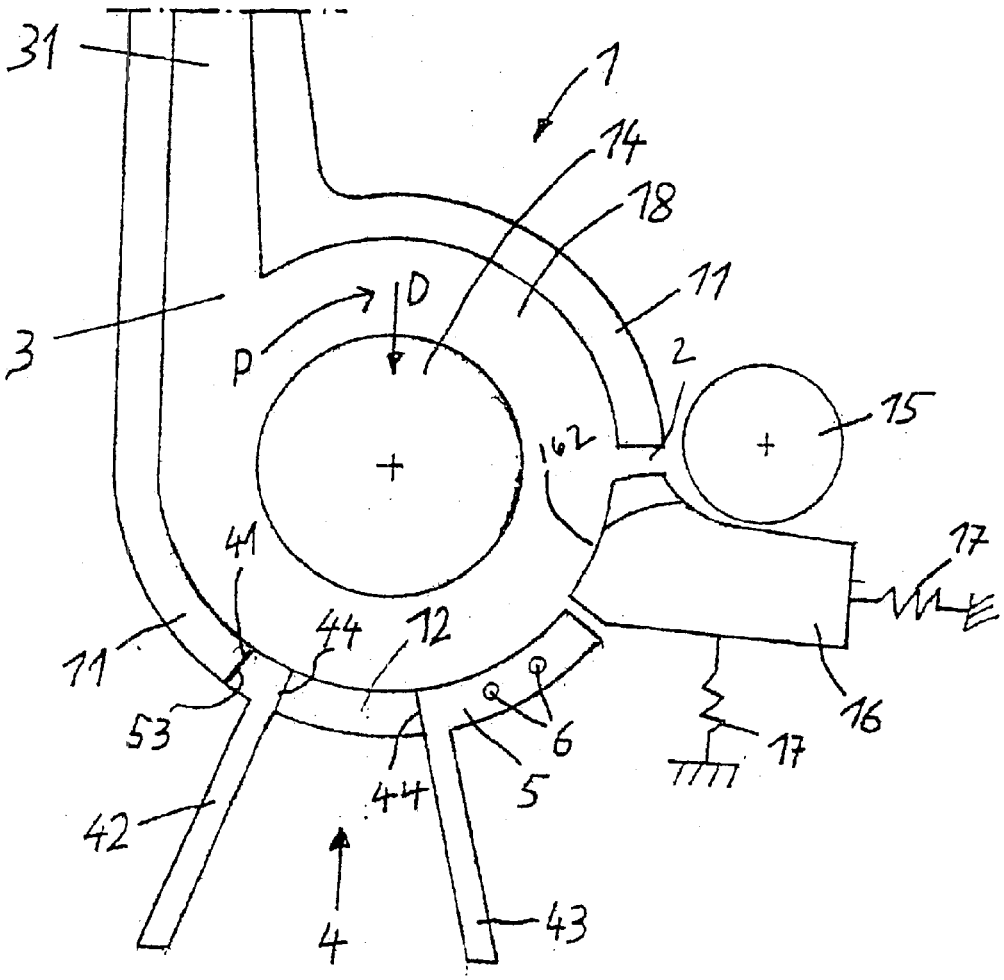
FIG. 1 shows a sectional presentation in profile of an invented disintegrator roll housing having an inset in accord with the invention.

The sectional view of FIG. 1 illustrates a profile view of the invented disintegrator roll housing with an invented insert, wherein the disintegrator roll is absent from its casing. For the mounting of the disintegrator roll, the disintegrator roll housing 1 has a round opening 14, through which passes, in operational conditions, a shaft, upon which the disintegrator roll is fastened. The disintegrator roll housing 1 has a feed opening 2 through which the fiber band (not shown) to be disintegrated is transported into the disintegrator casing 1 with the help of a feeding shaft 15. The feeding shaft 15 operates in a conventional manner, coactively functioning with a charging trough 16. The charging trough 16 confines the fiber band between itself and the feed shaft 15 by means of elastic elements 17, so that between the fiber band and the feed shaft no slippage occurs and the fiber band can be controllably fed into the disintegrator roll housing 1.

For the lateral guidance of the fiber band in the area of the charging trough 16, this trough 16 possesses two limiting sides, through which the fiber band is guided in the area of the charging trough 16, as seen in the axial direction of the feed shaft 15. The direction of rotation of the disintegrator roll is designated by the arrow P. After the area of the limiting sides, the charging trough 16 connects to a still another fiber band support 162, which, in this area likewise forms a part of the circumferential wall 11 of the disintegrator roll housing 1. As seen in the direction of rotation P, following the charging trough 16, the invented insert 5 is connected, which will be discussed later. In accord with each formation of the charging trough 16, it is possible, at least partially, that the insert 5 can also include the fiber band support 162.

After the insert 5, in the circumferential direction of the arrow P, the disintegrator roll housing 1 has in addition a circumferential wall 11, which finally transforms into an exit opening 3, through which, in a known manner, the disengaged fibers are ejected from the disintegrator roll housing 1, wherein the fibers are conducted to spinning mechanism, for example, an open-end spinning apparatus. The exit opening 3 connects into a fiber feed conduit 31. Following the exit opening 3, as seen in the direction of rotation P of the disintegrator roll, the disintegrator roll housing 1 is equipped with the circumferential wall 11, which extends as far as the band feed opening 2.

The insert 5, which is located between the charging trough 16 and an abutment 41 of the disintegrator roll housing 1, is exchangeably attached onto the side wall 18 of the disintegrator roll housing 1 by fasteners 6, which may be bolts or through-pins. In the area between the charging trough 16 and insert 5, there is to be found a small streamlined slot in the circumferential wall 11 of the disintegrator roll housing 1, the cross-section of which is regulated by the necessary moveability of the charging trough 16.

A contaminant separation opening 4 extends itself, as seen circumferentially, between the contamination separation wall 42 and the limiting wall 43. This extent is indicated by the lines 44. Between the two (separate) lines 44, which represent the length of the contamination separation wall 42 as well as that of the limiting wall 43, the insert 5 possesses the lateral border 12, which limits the extent of the contamination separation opening 4 in the axial direction, back to the side wall 18. Between the side limitation 12 and the opposite limitation 13 (see FIG. 2) as well as between the lines 44, is to be found the contamination separation opening 4.

Figure 2:
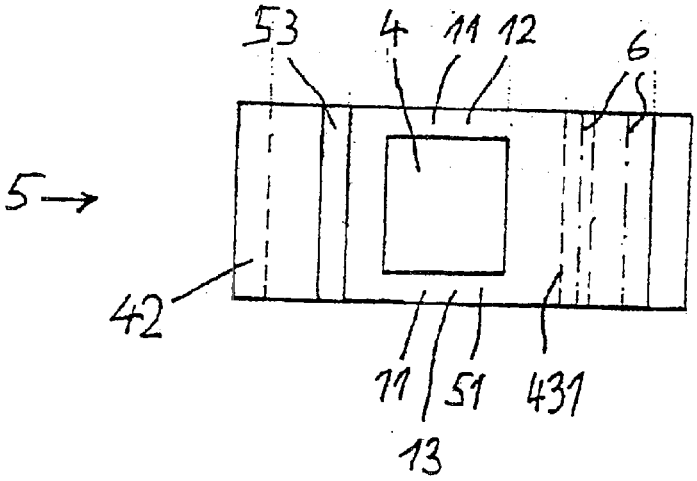
FIG. 2 shows a top view of the insert of FIG. 1.

Thus, the contamination separation opening 4, in the embodiment of FIG. 1, is designed as an opening in the insert 5, since the insert 5, both in its circumferential direction as well as in its axial direction, extends itself beyond the contamination separation opening 4 and, to a certain extent, also comprises part of the circumferential wall 11 of the disintegrator roll housing 1. In the direction of the arrow P, and after the contamination separation opening 4, the insert 5 possesses a contact surface 53, which, in the embodiment shown in FIGS. 1, 2, is not interrupted in the axial direction. This contact surface 53 strikes the abutment 41 of the disintegrator roll housing 1.

Upon an exchange of the insert 5, it is also possible that a determination can be made of both the size of the contamination separation opening 4 as well as its position in the circumferential direction of the circumferential wall 11 of the disintegrator roll housing 1, since the contamination separation opening 4 is an integral component of the insert 5. Principally, because the formation of the disintegrator roll housing 1, that is to say, its circumferential wall 11, determines the beginning of the insert 5 in the area of the charging trough 16, the length of the insert in the circumferential direction finds it limit at the abutment 41 of the circumferential wall 11 of the disintegrator roll housing 1. Between these two points, the position of the contamination separation opening 4, as well as its size can be practically optionally determined, that is, made to conform to the existing requirements of spinning-technology.

FIG. 2 shows a top view of the insert 5 of FIG. 1 in a view marked by arrow D of FIG. 1. When seen in axial direction, it is obvious from FIG. 2, that the insert 5 possesses both the lateral limitation 12 as well as the opposite limitation 13 of the contamination separation opening 4. Consideration can also be given to the fact, that the one lateral limitation 12 could be a part of the side wall 18 (see FIG. 1) of the disintegrator roll housing 1. A formation of this kind, however, would sharply restrict the flexibility of the insert 5.

The lateral limitations 12 and 13 of the contamination separation opening 4 form together a part of the circumferential wall 11 of the disintegrator roll housing 1. With this arrangement, even in the position of the contamination separation opening 4, the edge of the disintegrating roll is covered by the circumferential wall 11. Thereby, only the circumference of the disintegrator roll, which is supplied with an operative surface, lies opposite to the contamination separation opening 4. In this manner, an improved air inlet in the area of the contamination separation opening 4 is attained, so that contamination can be better separated out and the area of the edge of the disintegrator roll can be kept free of fiber accumulations.

In FIG. 2, a presentation of the fastening means 6 is presented in dotted lines. The insert 5 can be secured to the side wall 18 of the disintegrator roll housing 1 with the aid of these fastening elements 6. On the left side of the insert, as shown in FIG. 2, can be seen the contact surface 53 as well as the outside of the contamination separation wall 42. The limiting wall 43 is designated as an invisible edge by the use of the dotted lines 431. FIG. 2 further makes plain, that the location of the contamination separation opening 4 is more or less freely chosen on the insert 5. Likewise, the length of the contamination separation opening 4 in its circumferential direction is more or less freely chosen.

Figure 3:
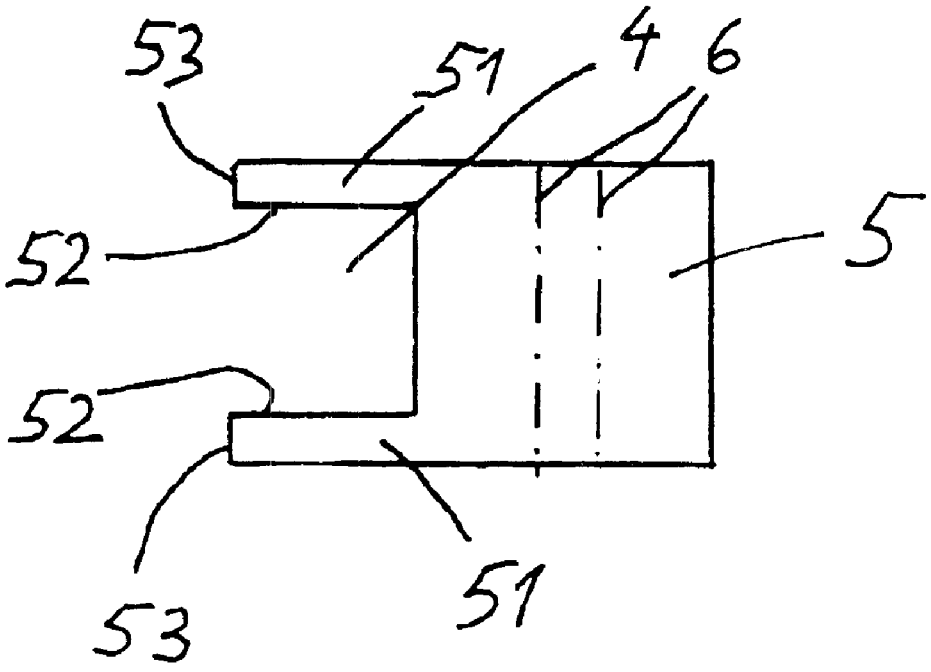
FIG. 3 shows a top view of an alternatively formed insert in accord with the invention.

FIG. 3 shows a top view similar to FIG. 2 of an insert in accord with the invention, whereby, however, the insert 5 does not encompass the contamination separation 4 from all sides. The lateral limitations of the contamination separation 4 take from the insert 5 of FIG. 3 two forklike extensions 51, which carry on their ends contact surfaces 53, with which the insert 5 strikes on the abutment 41 (see FIG. 1) of the circumferential wall 11. The fastening (not shown) of the insert 5 of FIG. 3 is carried out in the same manner as in insert 5 of FIGS. 1 and 2.

With the embodiment of the insert 5 shown in FIG. 3, the size of the contaminant separation opening is likewise determined. However, its exact position, in particular its position in the circumferential direction, is not exactly optional, since the one limitation of the contaminant separation opening 4 is fixed by means of the abutment 41 of the circumferential wall 11 of the disintegrator roll housing 1. In many insert cases, however, the residual advantages of the formation of the invented insert 5 in accord with FIG. 3 are fully sufficient, and permit an advantageous suitability and shaping of the contaminant separation opening 4 of the disintegrator roll housing 1. Especially where the modernization of the disintegration apparatuses of the machines of the state of the technology is concerned, this embodiment permits a favorable cost and rapid modernization even on machines, which cannot tolerate a stillstand of long duration. In that case, the segment, which forms the circumferential wall of the disintegrator roll housing 1 between the fiber feed opening 2 and the contaminant separation opening 4 is removed and replaced by the insert 5.

In order that the intake flow of air in the area of the contaminant separation opening 4 can be held free of turbulence, the edges 52 of the projections 51 of the insert 5 are designed to be rounded off. This formation is also advantageous when applied to the insert 5 in accord with FIG. 2.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A disintegrator roll housing of a disintegrator apparatus of an open-end spinning apparatus, said disintegrator roll housing comprising:

side walls forming two sides of said disintegrator housing;

a circumferential wall disposed between said side walls, said circumferential wall forming at least one side of a feed opening for the feeding of at least one fiber band and forming an exit opening through which fibers from said fiber band are removed from said disintegrator roll housing; and an insert positioned between said sidewalls and after said feed opening in a direction of rotation of a disintegrator roll disposed within said disintegrator roll housing, said insert at least partially forming a contaminant separation opening through which contaminants pass that are separated during disintegration of said fiber band and said insert acting as at least a portion of said circumferential wall between said feed opening and said contaminant separation opening in said direction of rotation of said disintegrator roll.

2. A disintegrator roll housing as in claim 1, wherein said circumferential wall includes an abutment positioned after said contaminant separation opening, said insert resting against said abutment.

3. A disintegrator roll housing of a disintegrator apparatus of an open-end spinning apparatus, said disintegrator roll housing comprising:

side walls forming two sides of said disintegrator housing;

a circumferential wall disposed between said side walls, said circumferential wall forming at least one side of a feed opening for the feeding of at least one fiber band and forming an exit opening through which fibers from said fiber band are removed from said disintegrator roll housing;

an insert positioned between said sidewalls and after said feed opening in a direction of rotation of a disintegrator roll disposed within said disintegrator roll housing, said insert acting as a portion of said circumferential wall and at least partially forming a contaminant separation opening through which contaminants pass that are separated during disintegration of said fiber band; and wherein at least one of said circumferential wall or said insert comprise lateral limitations on lateral sides of said contaminant separation opening.

4. A disintegrator roll housing as in claim 3, wherein said circumferential wall includes one lateral limitation and said insert includes an opposite lateral limitation.

5. An apparatus for use in a disintegrator roll housing of a disintegrator apparatus of an open-end spinning apparatus, said apparatus comprising an insert for use as a portion of a circumferential wall of said disintegrator roll housing, said insert having at least one projection that at least partially forms a contaminant separation opening through which contaminants pass that are separated during disintegration of a fiber band and said insert configured to be positionable in said disintegrator roll housing so that said insert defines at least a portion of said circumferential wall between a feed opening in said disintegrator roll housing and said contaminant separation opening as seen from a direction of rotation of said disintegrator roll.

6. An apparatus as in claim 5, wherein said insert comprises two projections disposed parallel to each other in a fork-shape.

7. An apparatus as in claim 5, wherein said insert forms restricting borders of said contaminant separation opening on at least two sides.

8. An apparatus as in claim 7, wherein said restricting borders on said inserts include rounded edges on said sides of said contaminant separation opening.

9. An apparatus as in claim 5, wherein said insert is exchangeable in said disintegrator roll housing.

10. An apparatus as in claim 5, wherein said insert includes at least one fastener.

11. An apparatus as in claim 5, wherein said projection includes a contact surface that abuts against said circumferential wall following said contaminant separation opening.

12. An apparatus for use in a disintegrator roll housing of a disintegrator apparatus of an open-end spinning apparatus, said apparatus comprising an insert for use as a portion of a circumferential wall of said disintegrator roll housing, said insert having at least one projection that at least partially forms a contaminant separation opening through which contaminants pass that are separated during disintegration of a fiber band and wherein said insert defines all sides of said contaminant separation opening.

13. An apparatus as in claim 12, wherein said insert includes a contact surface that abuts against said circumferential wall following said contaminant separation opening.

14. An apparatus as in claim 12, wherein said insert extends past said contaminant separation opening so that said insert acts as a portion of said circumferential wall following said contaminant separation opening.

15. An apparatus as in claim 12, wherein said insert includes a contaminant separation opening wall that follows said contaminant separation opening in a direction of travel of said fibers in said disintegrator roll housing.

16. An apparatus as in claim 5, wherein said insert includes a fiber band support for supporting said fiber band that is being fed into a feed opening in a disintegrator roll housing when said open-end spinning apparatus is in operation.

17. A procedure for renovating an open-end spinning apparatus having a disintegrator apparatus with a disintegrator roll housing, said procedure comprising the steps of:

removing a segment of a circumferential wall of the disintegrator roll housing located after a feed opening and before an exit opening in a direction of rotation of a disintegrator roll disposed within the disintegrator roll housing, the segment including at least a portion of the circumferential wall defining a contaminant separation opening; and replacing the segment with a replaceable insert that acts at least partially as the circumferential wall disposed between the feed opening and the contaminant separation opening as seen in the direction of rotation of the disintegrator roll, thereby redefining the contaminant separation opening.

18. An apparatus for use in a disintegrator roll housing of a disintegrator apparatus of an open-end spinning apparatus, said apparatus comprising an insert for use as a portion of a circumferential wall of said disintegrator roll housing, said insert having two projections that partially form a contaminant separation opening through which contaminants pass that are separated during disintegration of a fiber band with said two projections disposed parallel to each other in a fork-shape so that ends of said projections are abutable against a portion of said circumferential wall of said disintegrator roll housing that is located after said contaminant separation opening and before an exit opening in a direction of rotation of a disintegrator roll disposed within said disintegrator roll housing.

* * * * *